US011264194B2

(12) United States Patent
Hofsaess

(10) Patent No.: US 11,264,194 B2
(45) Date of Patent: Mar. 1, 2022

(54) TEMPERATURE-DEPENDENT SWITCH

(71) Applicant: Marcel P. Hofsaess, Steintahleben (DE)

(72) Inventor: Marcel P. Hofsaess, Steintahleben (DE)

( * ) Notice: Subject to any disclaimer, the term of this patent is extended or adjusted under 35 U.S.C. 154(b) by 0 days.

(21) Appl. No.: 17/024,237

(22) Filed: Sep. 17, 2020

(65) Prior Publication Data

US 2021/0090833 A1 Mar. 25, 2021

(30) Foreign Application Priority Data

Sep. 20, 2019 (DE) ..... 10 2019 125 452.3

(51) Int. Cl.

| | |
|---|---|
| ***H01H 37/54*** | (2006.01) |
| ***H01H 37/04*** | (2006.01) |
| ***H01H 37/52*** | (2006.01) |
| ***H01H 37/64*** | (2006.01) |
| ***H01H 37/74*** | (2006.01) |
| ***H01H 37/60*** | (2006.01) |

(52) U.S. Cl.

CPC ..... *H01H 37/5409* (2013.01); *H01H 37/04* (2013.01); *H01H 37/52* (2013.01); *H01H 37/60* (2013.01); *H01H 37/64* (2013.01); *H01H 37/74* (2013.01)

(58) Field of Classification Search

CPC ..... H01H 37/5409; H01H 37/5427; H01H 37/70; H01H 37/52; H01H 37/74; H01H 2037/549; H01H 37/04; H01H 37/60; H01H 37/64

USPC ..... 337/89, 367, 91

See application file for complete search history.

(56) References Cited

U.S. PATENT DOCUMENTS 3,925,742 A * 12/1975 Muench ..... H01H 50/326 335/186
4,053,859 A 10/1977 Hollweck
4,117,443 A * 9/1978 Hofsass ..... H01H 37/5409 337/348

(Continued)

FOREIGN PATENT DOCUMENTS

DE 2432901 A1 1/1976
DE 2544201 A1 4/1977

(Continued)

*Primary Examiner* — Anatoly Vortman

(74) *Attorney, Agent, or Firm* — Reising Ethington, P.C.

(57) ABSTRACT

A temperature-dependent switch comprises first and second stationary contacts and a temperature-dependent switching mechanism having a movable contact member and a temperature-dependent snap-action part, which transitions between geometric low- and high-temperature configurations based on a temperature of the switch. Switching the snap-action part from its geometric low- to high-temperature configuration moves the switching mechanism from a first to a second switching position and thereby opens the switch. A closing lock prevents the switch once having opened from closing again by keeping it in its second switching position. The closing lock comprises a fusible medium which melts when a melting temperature of the medium is exceeded, contacts, in a molten state, a part of the switching mechanism when it is in its second switching position, and solidifies again and thereby locks it in its second switching position when the temperature of the switch falls below the melting temperature of the medium again.

15 Claims, 4 Drawing Sheets

(56) References Cited

U.S. PATENT DOCUMENTS 4,470,033 A * 9/1984 Hofsass ..... H01H 37/5427 337/343
4,554,525 A * 11/1985 Bayer ..... H01H 37/5409 337/348
4,885,560 A * 12/1989 Niino ..... H01H 37/002 337/3
5,084,691 A 1/1992 Lester et al.
5,986,535 A * 11/1999 Stiekel ..... H01H 37/5427 337/298
6,191,680 B1 * 2/2001 Hofsass ..... H01H 37/002 337/333
6,249,211 B1 * 6/2001 Hofsaess ..... H01H 1/504 337/333
6,590,489 B1 * 7/2003 Ullermann ..... H01H 9/32 337/56
6,741,159 B1 * 5/2004 Kuczynski ..... H01H 37/002 337/142
7,071,809 B2 * 7/2006 Davis ..... H01H 37/5409 337/343
7,209,336 B2 * 4/2007 Yu ..... H01C 7/126 200/400
7,345,568 B2 * 3/2008 Yu ..... H01H 37/002 337/13
8,847,725 B2 * 9/2014 Buettner ..... H01H 37/54 337/365
9,640,351 B2 * 5/2017 Le Nguyen ..... H01H 37/04
9,691,576 B2 * 6/2017 Mitschele ..... H01H 1/504
2007/0188293 A1 * 8/2007 Yang ..... H01H 37/002 337/400
2013/0271258 A1 * 10/2013 Hofsaess ..... H01H 1/02 337/298
2014/0225709 A1 8/2014 Kirch et al.
2019/0221390 A1 7/2019 Hofsaess

FOREIGN PATENT DOCUMENTS

DE 2732439 A1 1/1978
DE 3014186 A1 10/1980
DE 8625999 U1 11/1986
DE 4321960 A1 1/1994
DE 102007042188 B3 4/2009
DE 102013101392 A1 8/2014
DE 102018100890 B3 7/2019
GB 2269480 A 2/1994

* cited by examiner

TEMPERATURE-DEPENDENT SWITCH

CROSS REFERENCE TO RELATED APPLICATIONS

This application claims priority from German patent application DE 10 2019 125 452.3, filed on Sep. 20, 2019. The entire contents of this priority application are incorporated herein by reference.

BACKGROUND

This disclosure relates to a temperature-dependent switch.

An exemplary temperature-dependent switch is disclosed in DE 10 2018 100 890 B3.

Such temperature-dependent switches are usually used for the purpose of protecting electrical devices from overheating. To this end, the switch is connected in series to the device to be protected and to the supply voltage thereof and is arranged mechanically on the device such that it is thermally connected to the device.

A temperature-dependent switching mechanism ensures that the two stationary contacts of the switch are electrically connected to each other below the response temperature of the switching mechanism. Hence, the circuit is closed below the response temperature and the load current of the device to be protected can flow through the switch.

If the temperature rises above an admissible value, the switching mechanism lifts off the movable contact member from the counter contact, opening the switch and disconnecting the load current of the device to be protected. The now current-less device can then cool down again. In this case, the switch, which is coupled thermally to the device, also cools down and would thereupon actually close again automatically.

However, in the case of the switch disclosed in DE 10 2018 100 890 B3, a closing lock ensures that this switching back does not occur in the cooled-down position, so that the device to be protected, once being switched off, cannot switch itself on again automatically. The closing lock mechanically locks the switching mechanism, so that the switching mechanism, once been opened, cannot close again, even if strong vibrations or temperature fluctuations occur.

This is a safety function that applies, for example, to electric motors that are used as drive units. This is intended in particular to prevent damage to the device or even injury to the person using the device.

Due to their switching behavior, such switches, which do not close again after being opened once, are also called one-time switches.

It goes without saying that "opening" the switch means the disconnection of the electrically conductive connection between the two contacts of the switch and not an opening of the switch housing in the mechanical sense.

A further switch of this type is disclosed in DE 10 2013 101 392 A1. This switch comprises a temperature-dependent switching mechanism having a temperature-dependent bimetal snap-action disc and a bistable spring disc which carries a movable contact or a current transfer member. When the bimetal snap-action disc is heated to a temperature above its response temperature, it lifts off the contact or the current transfer member from the counter contact or counter contacts against the force of the spring disc and thereby presses the spring disc into its second stable configuration in which the switching mechanism is situated in its high-temperature position.

When the switch and thus the bimetal snap-action disc cool down again, the bimetal snap-action disc returns to its low-temperature position. However, due its design, its edge cannot rest on a counter bearing, such that the spring disc remains in the stable second configuration in which the switch is open.

This means that the switch remains in its open position after opening once, even if it cools down again. However, tests carried out by the company of the applicant have shown that the switch disclosed in DE 10 2013 101 392 A1 does close again in the event of stronger mechanical vibrations such that—under safety aspects—it may not be the perfect solution in some applications.

There are also temperature-dependent switches with a so-called self-holding resistor which is connected in parallel with the two counter contacts so that it takes over part of the load current when the switch opens. Ohmic heat, which is sufficient to hold the snap-action disc above its response temperature, is generated in the self-holding resistor.

However, this so-called self-holding is only active for as long as the electric device is still switched on. As soon as the device is shut off from the supply circuit, no more current flows through the temperature-dependent switch either so that the self-holding function is cancelled. After the electric device has been switched on again, the switch would therefore be situated in the closed state again so that the device is able to heat up again, which could result in consequential damage.

This problem is avoided with the switches disclosed in DE 10 2007 042 188 B3 and DE 10 2013 101 392 A1, where the self-holding function is not realized electrically, but by means of a bistable spring part, which has two stable geometric configurations in a temperature-independent manner, as is described in the above-cited documents.

In contrast to this, the snap-action disc is a bistable snap-action disc that assumes either a high-temperature configuration or a low-temperature configuration in a temperature-dependent manner.

In the DE 10 2007 042 188 B3 mentioned at the outset, the spring disc is a circular snap-action spring disc on the middle of which the contact member is fastened. The contact member is, for example, a movable contact part which is pressed by the snap-action spring disc against the first stationary contact which is arranged on the inside of a cover of the housing of the switch. The snap-action spring disc presses by way of its edge against an inner bottom of a lower part of the housing which acts as a second contact. In this way, the snap-action spring disc, which is itself electrically conducting, produces an electrically conducting connection between the two counter contacts.

In its low-temperature position, the bimetal snap-action disc lies loosely against the contact part. If the temperature of the bimetal snap-action disc increases, it switches to its high-temperature position, in which it presses with its edge against the inside of the upper part of the housing and, concurrently with its center onto the snap-action spring disc such that the snap-action spring disc switches from its first to its second stable configuration, as a result of which the movable contact part is lifted off from the stationary contact and the switch is opened.

If the temperature of the switch cools down again, the bimetal snap-action disc switches back to its low-temperature position again. In this case, it moves with its edge into abutment with the edge of the snap-action spring disc and with its center into abutment with the upper part of the housing. However, the actuating force of the bimetal snap-action disc is not sufficient to let the snap-action spring disc switch back into its first configuration again.

The bimetal snap-action disc only bends further once the switch has cooled down a lot such that it is finally able to press the edge of the snap-action spring disc onto the inner bottom of the lower part by such a distance that the snap-action spring disc switches into its first configuration again and closes the switch again.

The switch disclosed in DE 10 2007 042 188 B3 therefore, after being opened once, remains open until it has cooled down to a temperature below room temperature, for which purpose a cooling spray can be used, for example.

Although the switch meets the corresponding safety requirements in many applications, it has nevertheless been shown that as a result of bracing the bi-metal snap-action disc between the upper part of the housing and the edge of the snap-action spring disc, in rare cases the snap-action spring disc nevertheless springs back in an unwanted manner.

DE 10 2013 101 392 A1 discloses a switch having a current transfer member as a movable contact member, for example in the form of a contact plate supported by the snap-action spring disc. Both stationary contacts are now arranged on the inner surface of the cover of the housing, wherein an electrically conductive connection between these two contacts is produced by placing the contact plate against these two contacts.

In the case of the switch, the snap-action spring disc is fixed with its edge on the lower part of the housing, while the bimetal snap-action disc is provided between the snap-action spring disc and the inner bottom of the lower part.

Below the response temperature of the bimetal snap-action disc, the snap-action spring disc presses the contact plate against the two stationary contacts. If the bimetal snap-action disc switches to its high-temperature position, it presses with its edge against the snap-action spring disc and pulls with its center the snap-action spring disc away from the upper part, so that the contact plate moves out of abutment with the two counter contacts. In order to make this geometrically possible, the contact plate, the snap-action spring disc and the bimetal snap-action disc are captively connected to each other by a centrally extending rivet.

When the temperature of the bimetal snap-action disc drops again, it switches back into its low-temperature position, but the spring disc remains in its assumed configuration as the bimetal snap-action disc lacks a counter bearing for its edge so that it is not able to press the current transfer member against the two stationary contacts again.

The switch therefore comprises a self-holding function due to the design. In rare cases, in the event of strong mechanical vibrations, the snap-action spring disc can spring back unintentionally here too.

Further, DE 25 44 201 A1 discloses a temperature-dependent switch having a current transfer member realized as a contact bridge, where the contact bridge is pressed against two stationary counter contacts via a closing spring. The contact bridge is in contact via an actuating bolt with a temperature-dependent switching mechanism which consists of a bimetal snap-action disc and a spring disc, both of which are clamped at their edges.

As with the switch disclosed in DE 10 2007 042 188 B3, the spring disc and the bimetal snap-action disc are both bistable, the bimetal snap-action disc in a temperature-dependent manner and the spring disc in a temperature-independent manner.

If the temperature of the bimetal snap-action disc increases, it presses the spring disc into its second configuration, in which it presses the actuating bolt against the contact bridge, lifting it off the stationary counter contacts against the force of the closing spring.

Even when the bimetal snap-action disc cools down, the spring disc remains in the second configuration and keeps the switch open against the force of the closing spring.

Pressure can then be exerted onto the contact bridge from outside by means of a button such that, as a result, the spring disc is pressed back into its first stable configuration by means of the actuating bolt.

Along with the very complex design, the switch, on the one hand, comprises the disadvantage that in the open state, the spring disc lifts the contact bridge from the counter contacts against the force of the closing spring so that the spring disc, in its second configuration, has to overcome the force of the closing spring in a reliable manner. Because the closing spring, however, in the closed state ensures the secure abutment of the contact bridge against the counter contacts, a spring disc with a very high degree of stability is required here in the second configuration.

A further switch with three switching positions is disclosed in DE 86 25 999 U1. It comprises a flexible tongue, which is clamped-in at one end and carries a movable contact part at its free end, wherein the movable contact part interacts with a fixed counter contact.

A calotte is formed on the flexible tongue, which calotte is pressed into its second configuration, in which it distances the movable contact part from the stationary counter contact, by means of a bimetal plate which is also attached to the flexible tongue.

In the case of the switch, the calotte has to hold the movable contact part at a distance from the fixed counter contact against the closing force of the flexible tongue which is clamped-in at one end so that the calotte has to apply a high actuating force in its second configuration.

The switch consequently comprises the above-discussed disadvantages, namely that high actuating forces have to be overcome, which leads to high production costs and to a non-secure state in the cooled-down position.

The switch disclosed in DE 10 2018 100 890 B3, which was mentioned at the outset, has the mechanically most stable closing lock compared to the other mentioned switches. Due to the mechanical locking of the switching mechanism, which is produced by the closing lock, an accidental switch back after the switch has been open once is almost impossible.

It has been shown, however, that the closing lock disclosed in DE 10 2018 100 890 B3 is relatively complex to manufacture, so that the manufacturing costs of the switch are comparatively high.

SUMMARY

It is an object to provide a switch that it is easier and thus cheaper to manufacture and yet still guarantees a safe disconnection of the electric circuit even in the cooled-down position of the switch and in the event of strong vibrations.

According to a first aspect, a temperature-dependent switch is provided, which comprises a first stationary contact, a second stationary contact, and a temperature-dependent switching mechanism having a movable contact member, wherein in a first switching position, the switching mechanism presses the movable contact member against the first stationary contact, thereby producing an electrically conductive connection between the first stationary contact and the second stationary contact via the movable contact member, and, in a second switching position, the switching mechanism keeps the movable contact member spaced at a distance from the first stationary contact, thereby disconnecting the electrically conductive connection, wherein the temperature-dependent switching mechanism comprises a temperature-dependent snap-action part, which is configured to switch from a geometric low-temperature configuration to a geometric high-temperature configuration upon reaching a switching temperature, and which is configured to switch back from the geometric high-temperature configuration to the geometric low-temperature configuration upon subsequently reaching a reset temperature that is lower than the switching temperature, wherein a switching of the temperature-dependent snap-action part from the geometric low-temperature configuration to the geometric high-temperature configuration moves the switching mechanism from the first switching position to the second switching position, thereby opening the switch, and wherein a closing lock is provided that prevents the switch once having opened from closing again by keeping the switching mechanism in its second switching position, wherein the closing lock comprises a fusible medium which is configured to melt when a temperature of the switch exceeds a melting temperature of the medium, to contact, in a molten state, a part of the switching mechanism when the switching mechanism is in the second switching position, and to subsequently solidify again and thereby lock the switching mechanism in its second switching position when the temperature of the switch falls below the melting temperature of the medium again.

Because the closing lock locks the switching mechanism in a similar manner as the switch disclosed in DE 10 2018 100 890 B3, it cannot close again after having opened once, even in the event of strong mechanical vibrations. Consequently, the locking of the temperature-dependent switch also locks the switch, which is herein used synonymously. The switch is thus prevented from switching back.

However, in contrast to the switch disclosed in DE 10 2018 100 890 B3, the herein presented switching mechanism is not mechanically locked by latching. Instead, the switching mechanism is locked by means of a fusible medium that contacts the switching mechanism in its second switching position (open position) and solidifies when the switch cools down below the melting temperature of the medium.

The solidification of the medium preferably creates an adhesive connection, especially preferably a firmly bonded connection, between a part of the switching mechanism and a part of the switch housing in which the switching mechanism is arranged. The switching mechanism thus adheres to a part of the switch housing as soon as the medium solidifies. The switching mechanism can then no longer be moved.

When the temperature-dependent snap-action part reaches or falls below its reset temperature, it attempts to switch back into its geometric low-temperature configuration again and to press thereby the movable contact member back against the first contact again, in order to produce an electrically conductive connection between the two contacts. However, this re-closing of the switch is prevented by the adhesive or firmly bonded connection that is caused by the solidified medium between a part of the switching mechanism and a part of the switch housing.

The closing lock produced in this way is very easy to manufacture. A fusible medium only has to be arranged at a suitable place, which fusible medium comes into contact with a part of the switching mechanism when it is in its second switching position. The fusible medium should be suitable to create an adhesive connection between this part of the switching mechanism and a part of the switch housing by solidifying.

The material costs for this fusible medium, that is to be provided additionally, as well as the manufacturing costs for the arrangement of this fusible medium inside the switch are conceivably small.

The above-mentioned object is achieved in full in this manner.

According to a preferred refinement, the fusible medium is configured to contact, in the molten state, the movable contact member when the switching mechanism is in its second switching position. In particular, the fusible medium is configured to create an adhesive or firmly bonded connection between the movable contact member of the switching mechanism and a part of the housing as soon as the temperature of the switch falls below the melting temperature of the medium again after the melting temperature of the medium has been exceeded and the medium solidifies.

This has the advantage that the movable contact member is usually designed as a solid component, making it very suitable for being connected to a part of the housing by means of the medium that is melted first and then solidified. Since the movable contact member usually offers, in particular at its lower side, a very large surface area for such an adhesive or firmly bonded connection with the housing, a mechanically very stable closing lock can be created by the adhesive or firmly bonded connection.

For example, it may be provided that the fusible medium is stored in a reservoir that is arranged in the housing.

It may also be provided that the fusible medium is stored in a reservoir which is contacted by the movable contact member when the temperature-dependent snap-action part switches from its geometric low-temperature configuration to its geometric high-temperature configuration and moves the switching mechanism from its first switching position to its second switching position.

Such a reservoir can be realized, for example, by a recess, an essentially pot-shaped receptacle or a simple container that is arranged inside the switch.

Storing the fusible medium inside such a reservoir provides the advantage that the medium does not spread within the switch after it has melted, which could affect other components of the switch. Furthermore, such a reservoir provides the advantage that the position of the fusible medium can be precisely aligned relative to the switching mechanism, such that it can be guaranteed that the movable contact member contacts the reservoir or the fusible medium contained therein in the second switching position of the switching mechanism.

In another preferred refinement, the housing comprises a lower part that is closed by an upper part, wherein the first stationary contact or each of the two stationary contacts is arranged on an inner side of the upper part, and wherein the reservoir is arranged in the lower part in such a way that the movable contact member contacts the medium with its underside facing away from the upper part, when the temperature-dependent snap-action part switches from its geometric low-temperature configuration to its geometric high-temperature configuration and moves the switching mechanism from its first switching position to its second switching position. For this purpose, the reservoir is preferably arranged on an inner bottom surface of the lower part below the movable contact member.

This has the advantage of a space-saving accommodation of the reservoir and the fusible medium stored therein, since with conventional switches of this type there is anyhow sufficient space for this in the lower part. With most of the prior art switches, the movable contact member is anyhow moved towards the inner bottom surface of the lower part when the switching temperature of the temperature-dependent snap-action part is reached. In the second switching position of the switching mechanism, the movable contact member thus automatically contacts the molten medium and remains attached to the lower part of the housing after the medium has solidified.

According to a refinement, the reservoir is integrated directly into the inner bottom surface of the lower part. For example, a closed contour can be formed into the inner bottom surface, which closed contour serves as a reservoir for the fusible medium. Likewise, the reservoir can be formed by a bead projecting from the inner bottom surface, which bead forms a closed, e.g. circular, contour that surrounds the fusible medium.

According to a further refinement, the reservoir comprises a container that is connected to the lower part by means of a non-positive, positive and/or firmly bonded connection.

The container can be a kind of inlay, for example, which is inserted into the lower part of the housing and welded, soldered or glued to the inner bottom surface. Alternatively or additionally, the container can be crimped or clamped to the inner bottom surface of the lower part.

Preferably, the fusible medium is a solder. Particularly preferably, the fusible medium is a soft solder. In principle, however, a hard solder can be used.

The use of a solder has the particular advantage that it creates a mechanically extremely stable firmly bonded connection between the part of the switching mechanism and the part of the housing, which are joined together by the solder.

According to a refinement, the melting temperature of the medium or solder is higher than the reset temperature of the temperature-dependent snap-action part.

This has the advantage that the firmly bonded connection, which acts as a closing lock and locks the switching mechanism in its second switching position, has already cooled down and is thus solidified before the temperature-dependent snap-action part, upon reaching its reset temperature, tries to move the contact member again to the first stationary contact and to close the switch thereby.

Upon reaching the reset temperature, the firmly bonded connection, which is created by the solidified medium and holds the switching mechanism in its second switching position, prevents the temperature-dependent snap-action part from switching from its high-temperature configuration back into its low-temperature configuration.

Furthermore, it is preferred that the melting temperature of the fusible medium or solder is lower than the switching temperature of the temperature-dependent snap-action part.

This has the advantage that the medium or solder has already melted when, upon reaching the switching temperature, the switching mechanism is moved by the temperature-dependent snap-action part from its first switching position to its second switching position and contacts the fusible medium or solder. Since the switch is then open, the temperature of the switch and thus the temperature of the fusible medium or solder drops, such that it can solidify again and create the above-mentioned firmly bonded connection between the switching mechanism and the switch housing.

However, the melting temperature of the medium or solder does not necessarily have to be lower than the switching temperature of the temperature-dependent snap-action part. It can also be slightly higher than the switching temperature of the temperature-dependent snap-action part and can be in the range of the switch's overshoot temperature, for example. The "overshoot temperature" is typically the temperature or temperature range to which the switch typically increases to a maximum after it has been switched off. Normally, the temperature will still slightly overshoot after the switch is turned off, even if the switch is already open, because the switch will continue to heat up due to the residual heat of the device to be protected.

If the melting temperature of the medium or solder is located in the range of this overshoot temperature, the medium or solder has not yet melted when the switching mechanism contacts it upon switching into its second switching position. However, the medium or solder will then melt afterwards, so that the firmly bonded connection can be produced even if the switch and thus the medium or solder later cools down again to a temperature below the melting temperature of the medium or solder.

According to a further refinement, it is provided that the switching mechanism comprises a temperature-independent spring part which is connected to the movable contact member, whereby the temperature-dependent snap-action part acts on the spring part when the switching temperature is exceeded, thereby lifting off the movable contact member from the first contact. It is particularly preferred that the spring part is a bistable spring part having two temperature-independent, stable geometric configurations.

If the spring component is designed as a bistable spring disc, it is preferred that the spring disc in its first stable configuration presses the movable contact member against the first contact and in its second stable configuration keeps the movable contact member at a distance from the first contact. This has the advantage that in the closed state of the switch (in the first switching position of the switching mechanism) the spring disc causes the closing force and thus the contact pressure between the movable contact member and the first contact. This mechanically relieves the temperature-dependent snap-action part, which has a positive effect on its service life and the long-term stability of its response temperature (switching temperature).

If the spring part is designed as a bistable spring disc with two temperature-independent stable geometric configurations, this has the additional advantage that the bistable spring disc keeps the switch in its open state after it has been opened. Even if the temperature-dependent snap-action part then wants to switch back into its low-temperature configuration after the switch has cooled down to the reset temperature, the spring disc, in addition to the closing lock described above, holds the switch in its open position.

In such a case it is even possible that the melting temperature of the medium or solder is lower than the reset temperature of the temperature-dependent snap-action part. If the already open switch (switching mechanism in second switching position) cools down to the reset temperature, the closing lock is not yet activated, because the medium or solder has not yet solidified. However, the bistable spring part still holds the switch in its open position. If the switch then cools down even further to the melting temperature of the medium or solder, the closing lock is finally activated.

In the latter case, it is preferable that the temperature-dependent snap-action part is fixed to the movable contact member, but is apart from that in its geometric low-temperature configuration freely suspended inside the housing without being supported by the housing or any other part of the switch.

Since the temperature-dependent snap-action part in its low-temperature configuration cannot be supported by the housing or any other part of the switch, the temperature-dependent snap-action part can then not generate any closing force that presses the movable contact member against the first contact. The closing force is generated by the temperature-independent spring part. If the temperature of the switch and thus the temperature of the temperature-dependent snap-action part increases above its switching temperature, the temperature-dependent snap-action part will switch to its high-temperature configuration, in which it can be supported by the temperature-independent spring part or any other part of the switch and thus open the switch. If the temperature-dependent snap-action part switches back into its low-temperature configuration when the switch has cooled down below the reset temperature, the temperature-dependent snap-action part switches so to say "in the empty space" so that the switch is thereby not closed again. The bistable spring part then holds the switch in its open position. In addition, the closing lock acts as soon as the medium or solder has solidified upon reaching its melting temperature.

The temperature-dependent snap-action part is preferably designed as a bistable bi- or trimetal snap-action disc.

According to a further refinement, it is preferred that the movable contact member comprises a movable contact part interacting with the first contact, and that the spring part interacts with the second contact, wherein it is further preferred that the spring part, at least in its first geometric configuration, is electrically connected to the second contact via its edge.

A similar kind of configuration is disclosed in DE 10 2018 100 890 B3, DE 10 2007 042 188 B3 or DE 10 2013 101 392 A1. The result is that the temperature-dependent snap-action part is not temperature loaded in any position of the switch, but that the load current of the electrical device to be protected flows through the spring part.

In an alternative refinement, the movable contact member comprises a current transfer member that interacts with both contacts.

Here it is advantageous that the switch can carry considerably higher currents than the switch disclosed in DE 10 2007 042 188 B3. The current transfer member arranged on the contact member ensures the electrical short circuit between the two contacts when the switch is closed, so that not only the temperature-dependent snap-action part but also the temperature-independent spring part is no longer traversed by the load current. A switch with a similar configuration is disclosed in DE 10 2013 101 392 A1.

It goes without saying that the features referred to above and yet to be explained below can be used not only in the respective given combinations, but also in other combinations or alone without leaving the spirit and scope of this disclosure.

DESCRIPTION OF PREFERRED EMBODIMENTS

Figure 1:
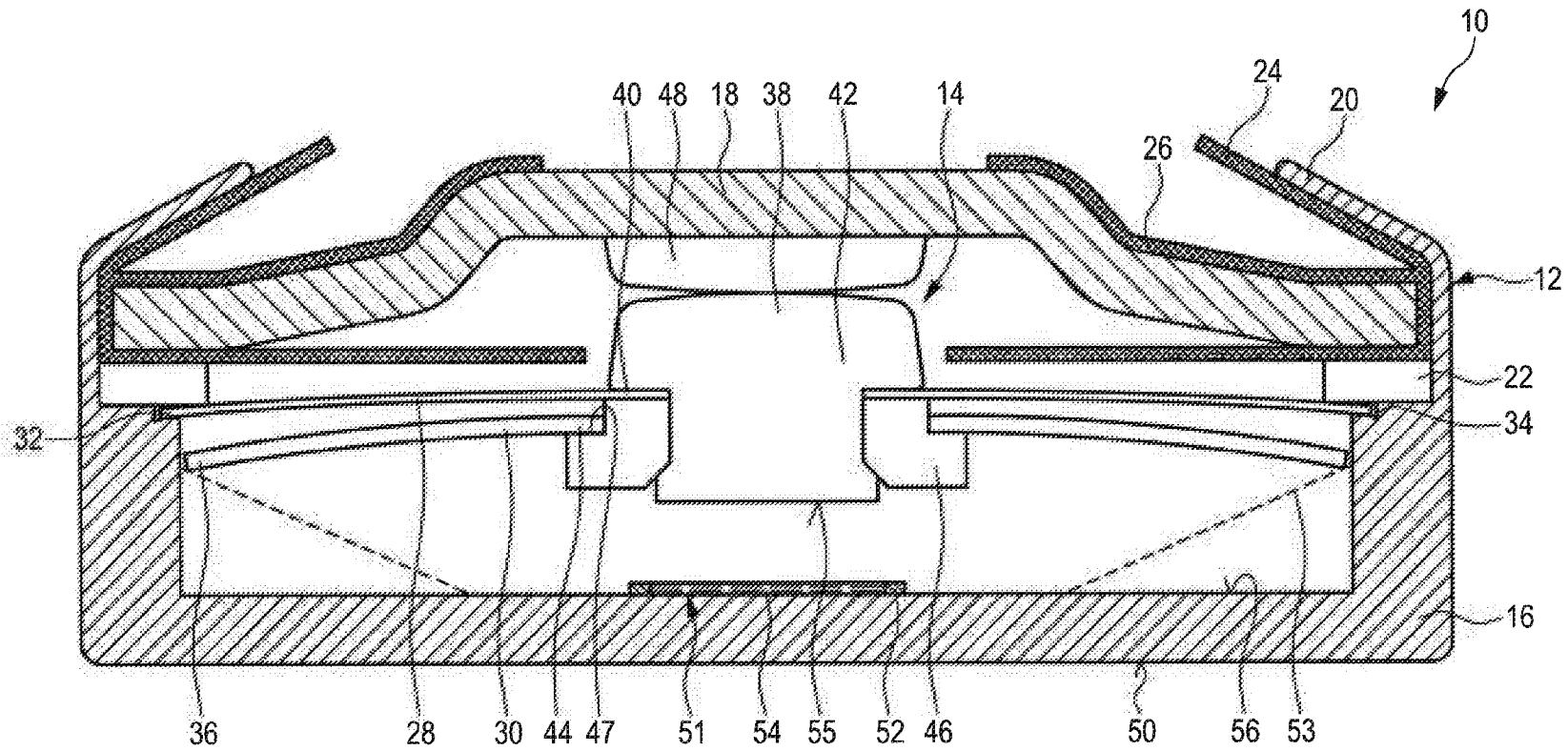
FIG. 1 shows a schematic sectional view of a first embodiment of the switch in its low-temperature position.

FIG. 1 shows a schematic sectional view of a switch 10, which is rotationally symmetrical in top view and preferably has a circular shape.

The switch 10 comprises a housing 12 in which a temperature-dependent switching mechanism 14 is arranged. The housing 12 comprises a pot-shaped lower part 16 and an upper part 18, which is held to the lower part 16 by a bent or flanged edge 20.

In the first embodiment shown in FIG. 1, both the lower part 16 and the upper part 18 are made of an electrically conductive material, preferably metal. A spacer ring 22, which supports the upper part 18 with an interposed insulating foil 24 and keeps the upper part 18 at a distance from the lower part 16, is arranged between the lower part 16 and the upper part 18.

The insulating foil 24 provides electrical insulation of the upper part 18 against the lower part 16. The insulating foil 24 also provides a mechanical seal that prevents liquids or impurities from entering the interior of the housing from outside.

Since the lower part 16 and the upper part 18 are in this embodiment each made of electrically conductive material, thermal contact to an electrical device to be protected can be produced via their outer surfaces. The outer surfaces are also used for the external electrical connection of the switch 10.

Another insulating foil 26 can be applied to the outside of the upper part 18, as shown in FIG. 1.

The switching mechanism 14 comprises a temperature-independent spring part 28 and a temperature-dependent snap-action disc 30. The spring part 28 is preferably designed as a bistable spring disc. Thus, this spring disc 28 has two temperature-independent stable geometric configurations. The first configuration is shown in FIG. 1. The temperature dependent snap-action disc 30 is preferably designed as a bimetal snap-action disc. The bimetal snap-action disc 30 has two temperature dependent configurations, a geometric high-temperature configuration and a geometric low-temperature configuration. In the first switching position of the switching mechanism 14 shown in FIG. 1, the bimetal snap-action disc 30 is in its geometric low-temperature configuration.

The spring disc 28 rests with its edge 32 on a circumferential shoulder 34 formed in the lower part 16 and is clamped between this shoulder 34 and the spacer ring 22. In contrast, the bimetal snap-action disc 30 is freely suspended in its low-temperature configuration shown in FIG. 1. It is freely suspended with its edge 36 and is not supported by this edge on any part of the housing 12 or any other part of the switch 10.

The spring disc 28 is with its center 40 fixed to a movable contact member 42 of the switching mechanism 14. The bimetal snap-action disc 30 is with its center 44 also fixed to the movable contact member 42. In the embodiment of the switch 10 shown in FIGS. 1 and 2, the movable contact member 42 comprises a ring 46 surrounding the movable contact member 42. This ring 46 is preferably pressed onto the movable contact member 42. It comprises a circumferential shoulder 47 on which the snap-action disc 30 rests with its center 44. The spring disc 28 is clamped between the ring 46 and the upper widened section of the contact member 42. In this way, the temperature-dependent switching mechanism 14 is a captive unit consisting of contact member 42, spring disc 28 and bimetal snap-action disc 30. When mounting the switch 10, the switching mechanism 14 can thus be inserted as a unit directly into the lower part 16.

On its upper side, the movable contact member 42 comprises a movable contact part 38. The movable contact part 38 interacts with a fixed counter contact 48, which is located on an inner side of the upper part 18. This counter contact 48 is herein also referred to as the first stationary contact. The outside of the lower part 16 serves as the second stationary contact 50.

In the position shown in FIG. 1, the switch 10 is in its low-temperature position, in which the temperature-independent spring disc 28 is in its first configuration and the temperature-dependent snap-action disc 30 is in its low-temperature configuration. The spring disc 28 presses the movable contact part 38 against the first stationary contact 48. In the closed, low-temperature position of the switch 10 as shown in FIG. 1, an electrically conductive connection is thus produced between the first stationary contact 48 and the second stationary contact 50 via the movable contact member 42 and the spring disc 28. The contact pressure between the movable contact part 38 and the first stationary contact 48 is generated by the temperature-independent spring disc 28. The temperature-dependent bimetal snap-action disc 30, on the other hand, is almost force-free in this state.

Figure 2:
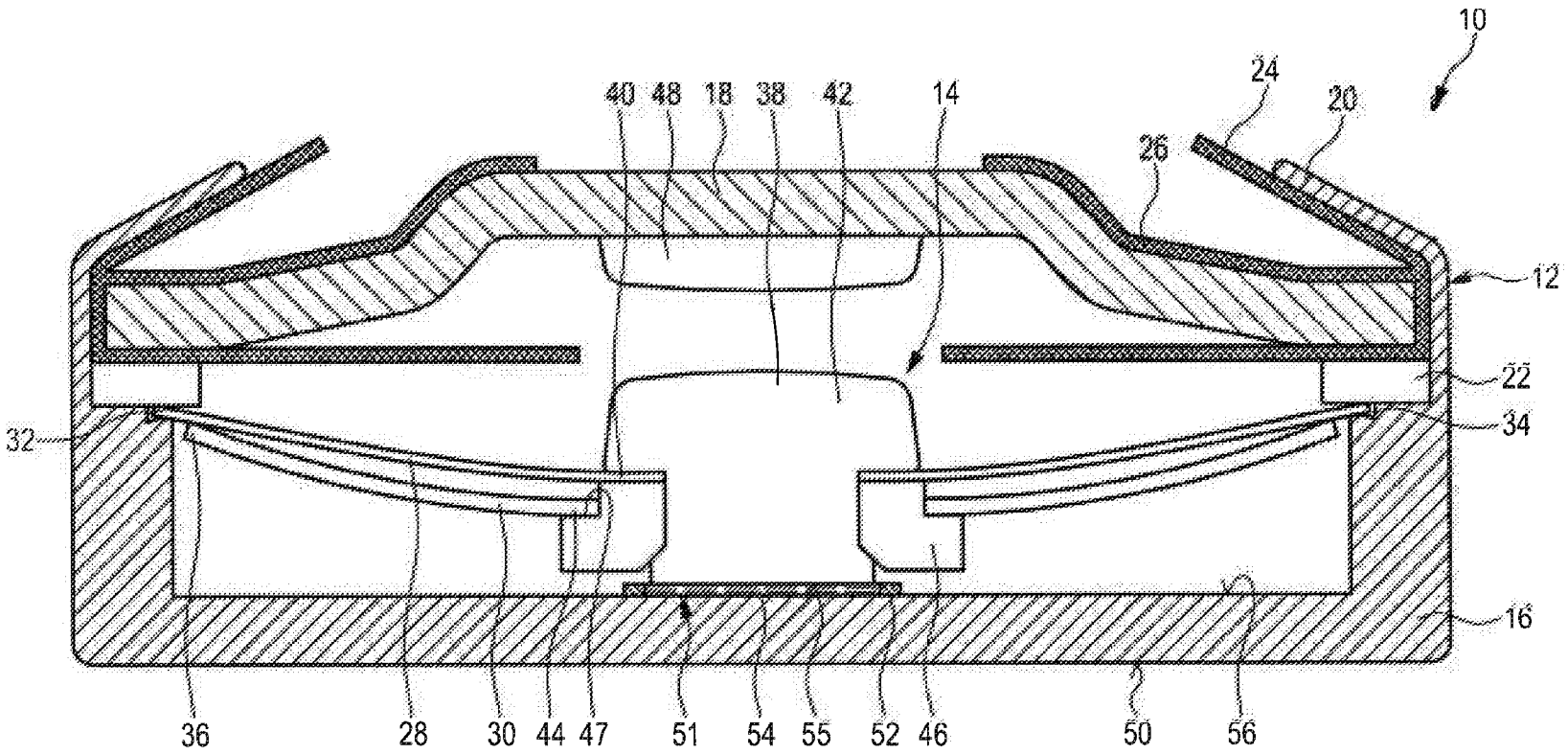
FIG. 2 shows a schematic sectional view of the first embodiment of the switch shown in FIG. 1 in its high-temperature position.

If the temperature of the device to be protected, and thus the temperature of the switch 10 and the bimetal snap-action disc 30 located therein, increases to the switching temperature of the snap-action disc 30 or beyond this switching temperature, the snap-action disc will switch from its convex low-temperature configuration shown in FIG. 1 to its concave high-temperature configuration shown in FIG. 2. When this snap-action occurs, the edge 36 of the bimetal snap-action disc 30 is supported by a part of the switch 10, in this case by the edge 32 of the spring disc 28. Thereby, the bimetal snap-action disc 30 pulls with its center 44 the movable contact member 42 downwards and lifts off the movable contact part 38 from the first stationary contact 48. This simultaneously causes the spring disc 28 to bend downwards at its center 40 so that the spring disc 28 switches from its first stable geometric configuration shown in FIG. 1 to its second stable geometric configuration shown in FIG. 2. FIG. 2 shows the high-temperature position of the switch 10 in which it is open. The electric circuit is thus disconnected.

When the device to be protected and thus the switch 10 including the bimetal snap-action disc 30 cool down again, the spring disc 28, upon reaching the reset temperature, switches back into its low-temperature position, as shown for example in FIG. 1. If the bimetal snap-action disc 30 cannot be supported by any part of the switch 10 in this low-temperature position, it switches so to say "in the empty space". Due to the bi-stability of the temperature-independent spring disc 28, the switch 10 would then remain open anyway.

However, this does not necessarily have to be the case, since the inner bottom of the lower part 16 may also be raised slightly at the sides, as shown in FIG. 1 by the dotted line 53. In this case, the bimetal snap-action disc 30 could rest with its edge 36 on this raised inner bottom 53. It is also possible that the bimetal snap-action disc 30 in its low-temperature position rests on a similar shoulder in the lower part 16 as the shoulder 34 on which the spring disc 28 rests. In these cases, switching back the bimetal snap-action disc 30 from its high-temperature position to its low-temperature position would cause the switch 10 to close again, in which case the bimetal snap-action disc 30 moves the movable contact member 42 upwards again and brings the movable contact part 38 into contact with the first stationary contact 48.

Irrespective of whether the bimetal snap-action disc 30 in its low-temperature position is able to rest on a part of the switch 10 or not, the described switch-back process is prevented by a closing lock 51. This closing lock 51 is caused by a fusible medium 54, which is arranged on the inner bottom surface 56 of the lower part 16. This fusible medium is preferably a solder, especially preferably a soft solder. This solder 54 is preferably stored in a reservoir or container which is arranged on and/or integrated into the inner bottom surface 56.

The fusible medium or solder 54 melts as soon as the temperature of the switch 10 reaches or exceeds a melting temperature of the medium or solder 54. If the solder 54 in this molten state then contacts a part of the switching mechanism 14 and solidifies afterwards again when the switch 10, and thus the solder 54, cools down again to a temperature below the melting temperature of the solder 54, the solder that has solidified at this point provides a firmly bonded or at least adhesive connection between the part of the switching mechanism 14 with which it comes into contact in the molten state and the lower part 16 of the switch 10.

In the herein shown embodiment, the movable contact member 42 contacts the solder 54 as soon as the switch 10 is opened upon reaching the switching temperature and the switching mechanism 14 is moved to its second switching position by means of the bimetal snap-action disc 30, as shown in FIG. 2. In this situation, the lower side 55 of the movable contact member 42 contacts the solder 54. Preferably, upon reaching the second switching position of the switching mechanism 14, the movable contact member 42 dips at least partially with its lower side 55 into the reservoir 52 that is filled with the solder 54. The solder 54 should then already have melted. Accordingly, a solder 54 is preferably selected whose melting temperature is below or in the range of the switching temperature of the bimetal snap-action disc 30. In principle, however, the melting temperature of the solder 54 can also be slightly higher than the switching temperature of the bimetal snap-action disc 30, since the switch 10 typically heats up a little more even after it has been opened and the circuit has been disconnected. This is known as temperature overshoot.

After reaching this so-called overshoot temperature, the device to be protected and thus also the switch 10 typically cools down again. As soon as the melting temperature of the solder 54 falls below the melting temperature during this cooling process, the solder solidifies. The lower side 55 of the movable contact member 42 then adheres firmly to the inner bottom surface 56 of the lower part 16. The closing lock 51 is thus activated.

Even if the switch 10 cools down to the reset temperature of the bimetal snap-action disc 30, the latter will attempt to switch back to its low-temperature position, but this is prevented by the closing lock 51, which holds the movable contact member 42 in its position shown in FIG. 2. The closing lock 51 caused by the solidified solder 54 prevents the switch 10 from switching back even if the bimetal snap-action disc 30 can rest on the raised inner bottom 53 or any other part of the switch 10 when switching back to its low-temperature position. In this case, however, the melting temperature of the solder 54 should be selected higher than the reset temperature of the bimetal snap-action disc 30, since the closing lock must already be activated in such a case (i.e. the solder must already have cooled down) before the bimetal snap-action disc 30 switches back from its high-temperature position to its low-temperature position.

The solder 54 used for the closing lock 51 can in principle also contact another part of the switching mechanism 14 when it is in its second switching position, for example, the bimetal snap-action disc 30. However, the advantage of creating a firmly bonded connection between the movable contact member 42 and the lower part 16 of the housing 12 using the solder 54 is that the movable contact member 42 is a relatively large and stable component that provides a large contact surface for such a firmly bonded connection. In addition, the inner bottom surface 56 of the lower part 16 provides anyhow sufficient space for mounting such a reservoir 52.

The reservoir 52, in which the solder 54 is preferably stored, can be made in different ways. It can be a simple recess or hole in the inner bottom surface 56. Similarly, the reservoir 52 may, for example, be in the form of a circular bead arranged on top of or being integrated the inner bottom surface 56 and forming a closed contour within which the solder 54 is stored. In principle, however, it is also possible to insert a separate container or a surrounding wall (e.g. a ring) as a separate component into the housing 12 of the switch 10 and to connect it to the inner bottom surface 56 in a non-positive, positive or firmly bonded manner.

The medium 54 does not necessarily have to be a solder. It can also be another fusible material or an adhesive that creates an adhesive connection between a part of the switching mechanism 14 and a part of the housing 12 in the second position of the switching mechanism 14.

Figure 3:
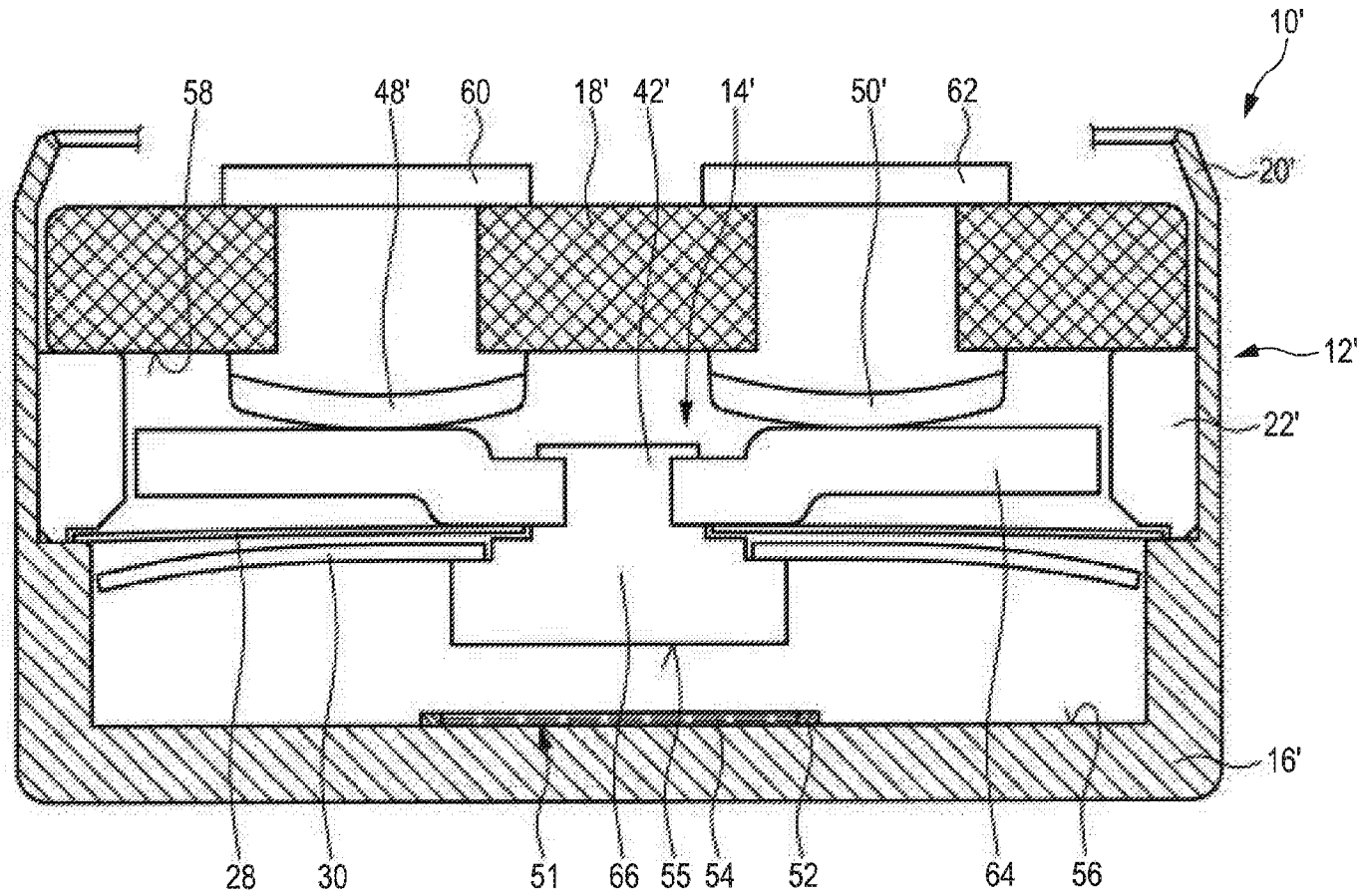
FIG. 3 shows a schematic sectional view of a second embodiment of the switch in its low-temperature position.
Figure 4:
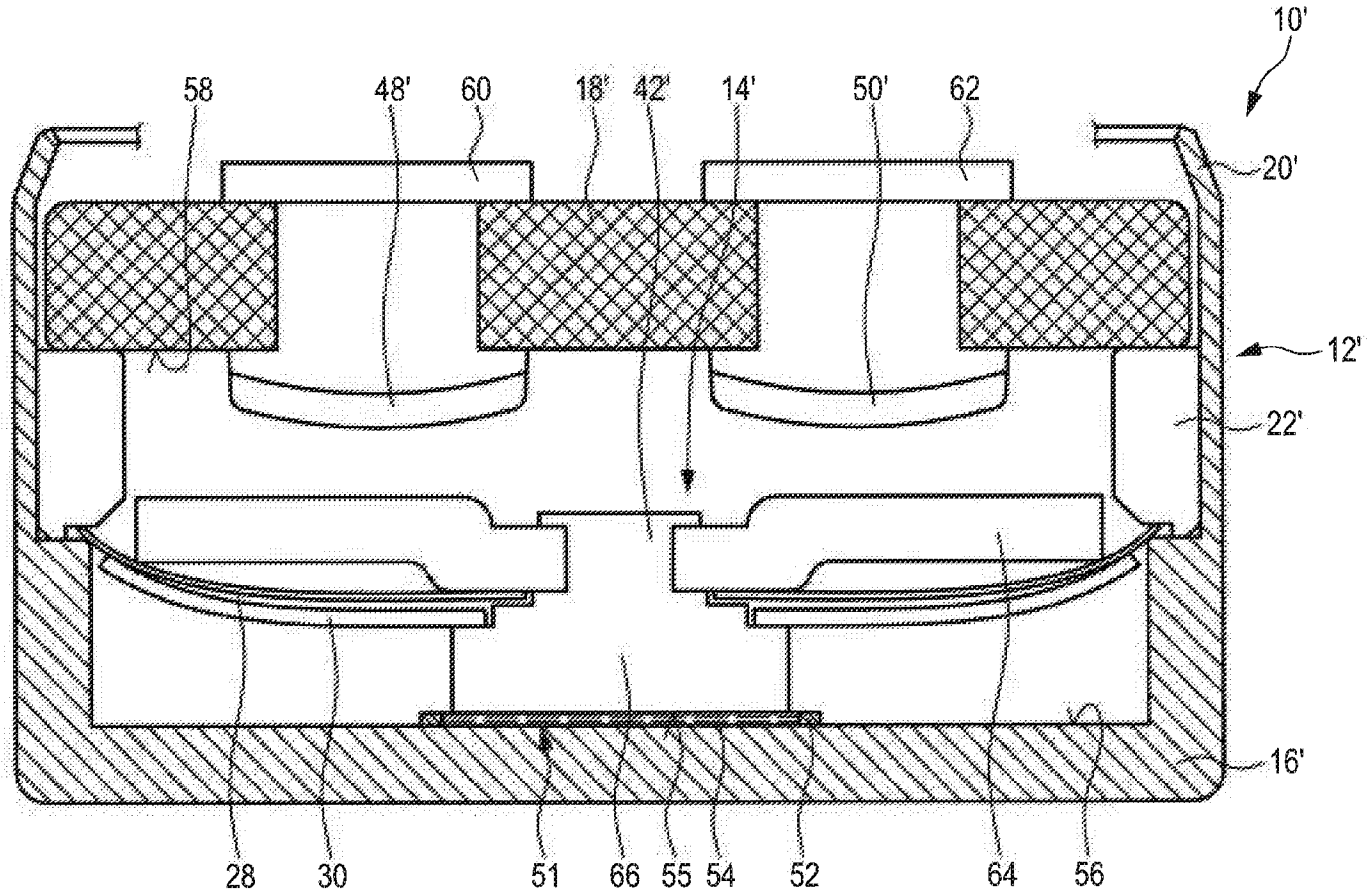
FIG. 4 shows a schematic sectional view of the second embodiment of the switch shown in FIG. 3 in its high-temperature position.

FIGS. 3 and 4 show a second embodiment of the switch 10'. FIG. 3 shows the closed position of the switch 10', in which the switching mechanism 14' is in its first switching position. FIG. 4 shows the open position of the switch 10', in which the switching mechanism 14' is in its second switching position.

The second embodiment shown in FIGS. 3 and 4 differs from the first embodiment shown in FIGS. 1 and 2 mainly by the design of the housing 12' and the design of the switching mechanism 14'. The closing lock 51 is, however, also in this case caused by a fusible medium 54, which is preferably arranged in a reservoir 52 on the inner bottom surface 56 of the lower part 16' and which, in the second switching position of the switching mechanism 14', ensures a firmly bonded or at least adhesive connection between the contact member 42' and the lower part 16' and thus prevents the switch 10' from switching back.

In the second embodiment shown in FIGS. 3 and 4, the lower part 16' is again made of an electrically conductive material. The flat upper part 18' is instead made of an electrically insulating material. It is held to the lower part 16' by a bent edge 20'.

Between the upper part 18' and the lower part 16', a spacer ring 22' is provided here as well, which keeps the upper part 18' at a distance from the lower part 16'. On its inner side 58, the upper part 18' comprises a first stationary contact 48' and a second stationary contact 50'. The contacts 48' and 50' are designed as rivets which extend through the upper part 18' and end outside in the heads 60, 62, which serve for the external connection of the switch 10'.

The movable contact member 42' in this case comprises a current transfer member 64, which is in this case designed as a contact plate, the upper side of which is coated with an electrically conductive coating so that it provides an electrically conductive connection between the two contacts 48' and 50' in the contact position shown in FIG. 3. The current transfer member 64 is connected to the spring disc and the bimetal snap-action disc 30 via a rivet 66, which is also to be regarded as part of the contact member 42'. In the second switching position of the switching mechanism 14', this rivet 66 contacts the fusible medium or solder with its lower side 55 (see FIG. 4), so that when the medium or solder 54 solidifies, a firmly bonded connection is produced between the movable contact member 42' and the lower part 16' of the switch 10' as before, thus preventing the switch 10' from closing again even upon reaching or undershooting the reset temperature.

An advantage of the switch design shown in FIGS. 3 and 4 is that, in contrast to the embodiment of the switch shown in FIGS. 1 and 2, no current flows through either the spring disc 28 or the bimetal snap-action disc 30 when the switch is closed. This current flows only from the first external connection 60 via the first stationary contact 48', the current transfer member 64 and the second stationary contact 50' to the second external connection 62.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A temperature-dependent switch, comprising: a first stationary contact, a second stationary contact, and a temperature-dependent switching mechanism having a movable contact member, wherein in a first switching position, the switching mechanism presses the movable contact member against the first stationary contact, thereby producing an electrically conductive connection between the first stationary contact and the second stationary contact via the movable contact member, and, in a second switching position, the switching mechanism keeps the movable contact member spaced at a distance from the first stationary contact, thereby disconnecting the electrically conductive connection, wherein the temperature-dependent switching mechanism comprises a temperature-dependent snap-action part, which is configured to switch from a geometric low-temperature configuration to a geometric high-temperature configuration upon reaching a switching temperature, and which is configured to switch back from the geometric high-temperature configuration to the geometric low-temperature configuration upon subsequently reaching a reset temperature that is lower than the switching temperature, wherein a switching of the temperature-dependent snap-action part from the geometric low-temperature configuration to the geometric high-temperature configuration moves the switching mechanism from the first switching position to the second switching position, thereby opening the switch, wherein a closing lock is provided that prevents the switch once having opened from closing again by keeping the switching mechanism in its second switching position, wherein the closing lock comprises a fusible medium which is configured to melt when a temperature of the switch exceeds a melting temperature of the medium, to contact, in a molten state, a part of the switching mechanism when the switching mechanism is in the second switching position, and to subsequently solidify again and thereby lock the switching mechanism in its second switching position when the temperature of the switch falls below the melting temperature of the medium again, wherein the melting temperature of the fusible medium is lower than the switching temperature of the temperature-dependent snap-action part.

2. The temperature-dependent switch according to claim 1, further comprising a housing, wherein the fusible medium is configured to produce an adhesive or firmly bonded connection between the part of the switching mechanism and a part of the housing, wherein the connection locks the switching mechanism in its second switching position.

3. The temperature-dependent switch according to claim 2, further comprising a reservoir that is arranged in the housing, wherein the fusible medium is stored in the reservoir.

4. The temperature-dependent switch according to claim 1, wherein the fusible medium is configured to contact, in the molten state, the movable contact member when the switching mechanism is in the second switching position.

5. The temperature-dependent switch according to claim 3, wherein the housing comprises a lower part and an upper part attached to the lower part, wherein the first stationary contact is arranged on an inner side of the upper part, and wherein the reservoir is arranged in the lower part in such a way that the movable contact member contacts the medium with a lower side that faces away from the upper part, when the temperature-dependent snap-action part switches from its geometric low-temperature configuration to its geometric high-temperature configuration.

6. The temperature-dependent switch according to claim 5, wherein the reservoir is arranged on an inner bottom surface of the lower part.

7. The temperature-dependent switch according to claim 6, wherein the reservoir comprises a container that is connected to the lower part by means of a non-positive, positive and/or firmly bonded connection.

8. The temperature-dependent switch according to claim 1, wherein the fusible medium comprises a solder.

9. The temperature-dependent switch according to claim 1, wherein the melting temperature of the medium is higher than the reset temperature of the temperature-dependent snap-action part.

10. The temperature-dependent switch according to claim 1, wherein the switching mechanism comprises a temperature-independent spring part which is connected to the movable contact member, wherein the temperature-dependent snap-action part is configured to act on the spring part upon reaching the switching temperature, thereby lifting off the movable contact member from the first stationary contact.

11. The temperature-dependent switch according to claim 10, wherein the spring part comprises a bistable spring disc having two temperature-independent, stable geometric configurations.

12. The temperature-dependent switch according to claim 10, wherein the movable contact member comprises a movable contact part that interacts with the first stationary contact, and wherein the spring part interacts with the second stationary contact.

13. The temperature-dependent switch according to claim 1, further comprising a housing, wherein the temperature-dependent snap-action part is fixed to the movable contact member, in its geometric low-temperature configuration the temperature-dependent snap-action part is freely suspended inside the housing without being directly supported by the housing.

14. The temperature-dependent switch according to claim 1, wherein the temperature-dependent snap-action part comprises a bimetal or trimetal snap-action disc.

15. The temperature-dependent switch according to claim 1, wherein the movable contact member comprises a current transfer member that is configured to interact with the first stationary contact.

* * * * *